US010001255B2

(12) United States Patent
Minsky

(10) Patent No.: US 10,001,255 B2
(45) Date of Patent: Jun. 19, 2018

(54) CUSTOM PRINTED LAMP SHADE

(71) Applicant: Schneur Minsky, Brooklyn, NY (US)

(72) Inventor: Schneur Minsky, Brooklyn, NY (US)

( * ) Notice: Subject to any disclaimer, the term of this patent is extended or adjusted under 35 U.S.C. 154(b) by 19 days.

(21) Appl. No.: 15/351,470

(22) Filed: Nov. 15, 2016

(65) Prior Publication Data

US 2018/0135828 A1 May 17, 2018

(51) Int. Cl.

| | |
|---|---|
| ***F21V 11/00*** | (2015.01) |
| ***F21V 1/26*** | (2006.01) |
| ***F21V 1/14*** | (2006.01) |
| ***F21V 1/22*** | (2006.01) |
| ***F21V 1/12*** | (2006.01) |
| *F21W 121/00* | (2006.01) |

(52) U.S. Cl.

CPC ..... *F21V 1/26* (2013.01); *F21V 1/12* (2013.01); *F21V 1/146* (2013.01); *F21V 1/22* (2013.01); *F21W 2121/00* (2013.01)

(58) Field of Classification Search

CPC ..... F21V 1/00–1/26

See application file for complete search history.

(56) References Cited

U.S. PATENT DOCUMENTS

| | | | | |
|---|---|---|---|---|
| 1,580,922 | A | 4/1926 | Scherer | |
| 4,344,115 | A | 8/1982 | Pickens et al. | |
| 5,736,233 | A | 4/1998 | Fye | |
| 7,347,593 | B1 | 3/2008 | Swanson | |
| 9,121,572 | B2 | 9/2015 | Lewis et al. | |
| 2002/0112386 | A1 | 8/2002 | Thomas | |
| 2003/0231488 | A1* | 12/2003 | Albee | A61L 9/03 362/96 |
| 2006/0050517 | A1* | 3/2006 | LaFleiche | B44C 5/005 362/351 |
| 2008/0130297 | A1 | 6/2008 | Hui | |
| 2009/0225553 | A1 | 9/2009 | Wu | |
| 2012/0081905 | A1* | 4/2012 | Santiago | F21V 1/22 362/294 |
| 2016/0097934 | A1 | 4/2016 | Harris | |

* cited by examiner

*Primary Examiner* — Sean Gramling
(74) *Attorney, Agent, or Firm* — Benjamin Davis

(57) ABSTRACT

The present invention generally concerns a custom lampshade with a digital print. More specifically, the lamp shade includes an end cap that joins with printing substrates capable of passing light. At least one end cap is used to shape and support a substrate having a digital image printed on at least one of its surfaces. The end cap has a center aperture with a diameter sized to accept a threaded portion of a shade rest or a diameter that is sized to accept a lamp socket. The end cap has an outer channel sized to accept the edges of a transparent substrate material. In another embodiment, the end cap is devoid of an outer channel, but is joined about its outer diameter with a translucent substrate material via an adhesive. When the lamp shade is used, a light source illuminates the digital image printed on either substrate.

7 Claims, 8 Drawing Sheets

CUSTOM PRINTED LAMP SHADE

RELATED APPLICATIONS

This patent application does not claim priority to any other filed patent applications.

FIELD OF THE INVENTION

The present invention generally concerns a custom lampshade with a digital print. More specifically, the lamp shade is a construct having at least one end cap that shapes various printing substrates into lamp shade walls. The printing substrates are capable of passing light and have digitally printed images on its surfaces that are illuminated by a light source. An end cap has a center aperture with a diameter sized to accept a shade rest of a lamp fitter or a diameter sized to accept a lamp socket. The end cap has an optional outer channel that accepts the edges of a transparent substrate material. In another embodiment, the lamp shade is formed by an end cap devoid of an outer channel having a translucent substrate joined about the end cap's outer diameter via an adhesive. When the lamp shade is used, a light source illuminates the digital image printed on either substrate.

BACKGROUND OF THE INVENTION

Lamp shades do more than attenuate or adjust light emanating from a light source. Lamp shades provide a surface to display art. Decorative lamp shades are typically made from fabrics, plastics, paper, or glass, an example being a lamp shade being made from a canvas material with adhesives and a plastic backing with images painted on the canvas, or a stain glass lamp shade made in many colors and shapes. However, paper and thin flexible plastics are not durable enough materials for accepting industrial UV-LED curable inks or solvent based inks from digital printers that print images on such substrates to further shape into lamp shades.

The present invention uses translucent or transparent substrates as printing materials for custom printed lamp shades, non-limiting examples being backlit film or acrylic glass respectively, where end caps are used to eventually fashion either material into a custom printed lamp shade. Either material is a good substrate for accepting digital images from printers that apply UV-LED curable inks or solvent based inks. The degree of light transmission of acrylic glass or backlit film is important because if the material is too opaque, then the printed image will appear dull and the colors of the digitally printed images will lose their vibrancy when illuminated. Light from incandescent bulbs or fluorescent tubes that emanate from a lamp should be highly diffused as it passes through either substrate or the illumination of the lamp shade and digitally printed image will not be uniform.

PMMA has a basic chemical structure as follows.

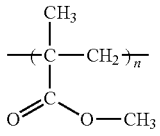

Commercial PMMA is sold as copolymerized products of acrylic acid, which includes both modified and unmodified acrylics. Trade names for acrylic glass may include without limitation Plexiglas®, ACRYLITE®, Lucite®, Perspex®, Altuglas®, Setapan®, Setacryl®, Lucryl®, Deglas®, Friacryl®, Hesa-Glas®, Limacryl®, Resarit®, Satin Glass®, Setasand®, or Setaletter®. Commercial acrylic glass is typically a transparent thermoplastic often used in sheet form as a lightweight or shatter-resistant alternative to traditional glass and is commonly prepared by copolymerizing a small amount of a co-monomer with methyl-methacrylate in order to inhibit depolymerization.

Backlit film is a polyester type material used in illuminated signage displays, where prints are viewed with a light source behind it. The effect requires the film, a digital printed image on such material, and a lightbox for illumination. Materials for backlit films are mostly flexible and create a compelling visual light effect. Backlit is typically made from specialty vinyl and laminate materials, including but not limited to, synthetic paper (polyolefine type, polystylene type, etc.); natural fiber paper such as cellulose fiber paper (wood-free paper, coated paper, latex impregnated paper, etc.); synthetic resin sheet or film (polyolefine, polyvinyl chloride, polyethylene-terephtharate, polystylene, polymethacrylate, polycarbonate, etc.). Examples of the resin to be used for the receiving layer may include polyester, polyacrylate, polycarbonate, polyvinyl acetate, styrene-acrylate resin, vinyl tolueneacrylate resin, polyurethane, polyamide, urea resin, polycaprolactone, styrene-maleic anhydride resin, polyvinyl chloride, polyacrylonitrile, etc. and mixtures, copolymers of these resins, and others.

U.S. Pat. No. 1,580,922 to A. Scherer discloses a lamp shade and a method for making the same.

U.S. Pat. No. 4,344,115 to Pickens, J., et al. discloses a translucent lamp shade having a tube with flanges that extend radially inward, a lens, and mounting brackets to attach the lamp to a ceiling. The outer portion of the tube is joined with a self decorative adhesive paper.

U.S. Patent Pub. No. 20080130297 as filed by Kowloon, G. H. discloses a lamp shade assembly having upper and lower rings that are clipped to the same.

U.S. Patent Pub. No. 20090225553 as filed by Wu, W. discloses a lamp shade having a top and bottom frame, a covering, and hook and loop materials to secure the covering to the frame.

U.S. Pat. No. 7,347,593 to Swanson, D. discloses a Giclee printed lamp shade and a method for making the same.

U.S. Patent Pub. No. 20020112386 as filed by Thomas, A. discloses a lamp shade being styrene that is capable of retaining and illuminating a printed image on a translucent film preferably being Duratrans photographic film.

U.S. Patent Pub. No. 20160097934 as filed by Harris, H. discloses an apparatus and method of manufacture for a layered artwork.

U.S. Pat. No. 9,121,572 to Lewis, J. D., et al. discloses a lamp shade and frame assembly that uses a cover material that includes an resilient opaque film.

U.S. Pat. No. 5,736,233 to Fye, M. E. discloses a method for making multicolored backlit materials.

None of the cited art discloses a custom printed lamp shade having at least one end cap capable of shaping various printing substrates into lamp shade walls, where the printing substrates pass light and have digitally printed images that are illuminated by a light source, and where the end cap has a center aperture that has a diameter sized to accepted a shade rest of lamp fitter or a diameter sized to accept a lamp socket. Therefore, there is a need for the present invention.

SUMMARY OF THE INVENTION

Aspects for a custom printed lamp shade are disclosed as follows. One aspect of the present invention includes a custom printed lamp shade having an end cap located at at least one distal end of a shaped substrate material with a digital image printed about its surfaces. The end cap includes a center aperture and an optional outer channel capable of accepting a thickness of the substrate material. Overlapping edges of the substrate material are secured by an adhesive.

It is an aspect of the current invention for an end cap to be made from materials including but not limited to acrylic glass, solid wood, natural wood, coniferous wood, hardwood, bamboo, balsa wood, mahogany, basswood, beech, poplar, birch, maple, Douglas fir, spruce, pine, fir, common beech, oak, ash, cherry, walnut, obeche, padouk, teak, veneer, plywood, laminated wood, cork, metal, Earthenware ceramic, technical ceramic, Macor (glass ceramic), ceramic composite, porcelain, earthenware, stoneware, pottery, clay mineral, porcelain stoneware, kaolin, or any combinations thereof.

It is an aspect of the current invention where the substrate material is an acrylic glass capable of accepting UV-LED curable inks from a digital printer.

It is an aspect of the current invention for the substrate material to be a backlit film capable of accepting solvent based inks or UV-LED curable inks from digital printers.

It is an aspect of the current invention where the acrylic glass substrate is softened by applying heat to the acrylic glass substrate close to its depolymerization temperature and guiding the softened acrylic glass substrate into the optional outer channel of the end cap.

Another aspect of the present invention includes the backlit film substrate being joined to an outer diameter of an end cap not having the optional outer channel by an adhesive and wherein the overlapping edges of the backlit film substrate are joined by an adhesive to form a supporting seam.

It is an aspect of the current invention where an end cap has a center hub that has an aperture and spokes that radiate outward to the outer edges of the same.

It is an aspect of the current invention where the center aperture has a diameter that is sized to accept the threaded portion of a shade rest of a lamp fitter or a diameter that is sized to accept a lamp socket.

Another aspect of the current invention includes end caps being laser cut to be substantially square, substantially triangular, or substantially circular.

It is an aspect of the current invention where all substrate materials are shaped by a substantially square, substantially triangular, or substantially circular end cap to form lamp shade walls having such corresponding shapes.

It is an aspect of the current invention where the digital image printed about the surfaces of the substrate material is illuminated by a light source associated with a lamp.

BRIEF DESCRIPTION OF DRAWINGS

The figures discussed below are non-limiting examples of the present invention and are intended to capture or contemplate common changes to the same.

DETAILED DESCRIPTION OF THE INVENTION

From this point forward, the following words will describe a custom printed lamp shade. FIGS. 2*a*-2*c* and FIG. 3 depict the present invention having at least one acrylic end cap to shape a substrate material with a digital image printed on its surface. All configurations of an end cap has a center aperture having a diameter that accepts either a threaded portion of a shade rest associated with a lamp fitter or is sized to accept a lamp socket. The end cap may be substantially solid or may be designed with a center hub having an aperture with spokes that radiate outward.

Figures 2A, 2B, 2C:
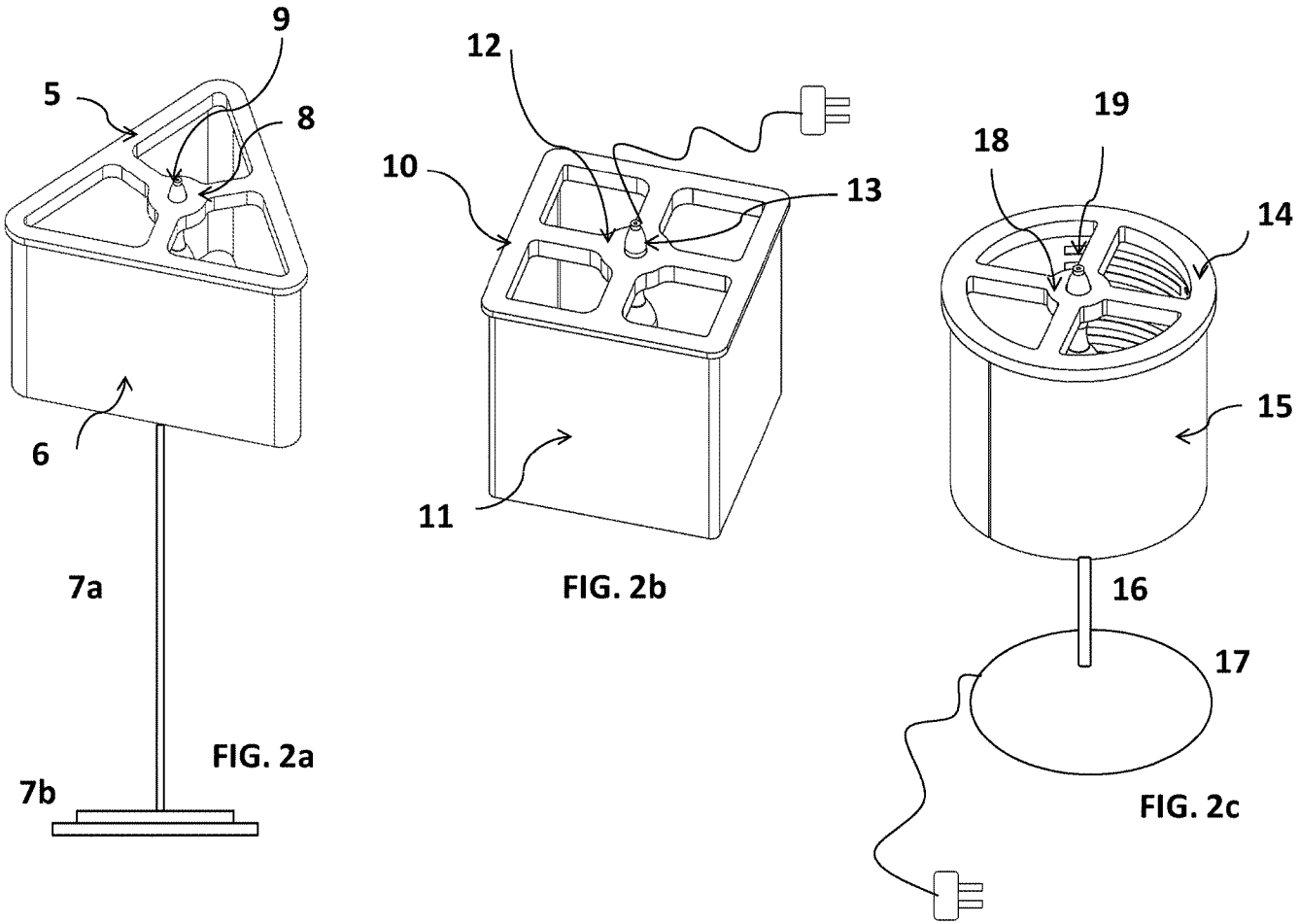
FIG. 2*a* depicts a lampshade with a substantially triangular end cap 5 that shapes an acrylic substrate 6 into a substantially triangular shape. The lamp shade hangs from a floor lamp having a tube 7*a* that extends to a base 7*b* that sits on a floor (not shown). The end cap 5 has a center aperture 8 that accepts a threaded portion of a shade rest 9 associated with a lamp fitter, where the remaining portion of the lamp shade hangs downward about the lamp. Three spokes radiate outward from a center hub having an aperture 8 to inner edges of the end cap 5.
FIG. 2*b* depicts a lampshade with a substantially square end cap 10 that shapes an acrylic substrate 11 into a substantially square shape. The lamp shade has a center aperture 11 with a diameter that is sized to accept a lamp socket 13 commonly found with pendant type lamps, which are lamps meant for hanging. Four spokes radiate outward from a center hub having an aperture 11 to inner edges of the end cap 10.
FIG. 2*c* depicts a lampshade with a substantially circular end cap 14 that shapes an acrylic substrate 15 into a substantially cylindrical shape. The lamp shade is shown as being used with a table lamp having a tube 16 that extends to a base 17 that sits on a desk (not shown). The end cap 14 has a center aperture 18 that mates with a threaded portion of a shade rest 19 associated with a lamp fitter, where the remaining portion of the lamp shade hangs downward. Four spokes radiate outward from a center hub having an aperture 18 to inner edges of the end cap 14.
Figure 3:
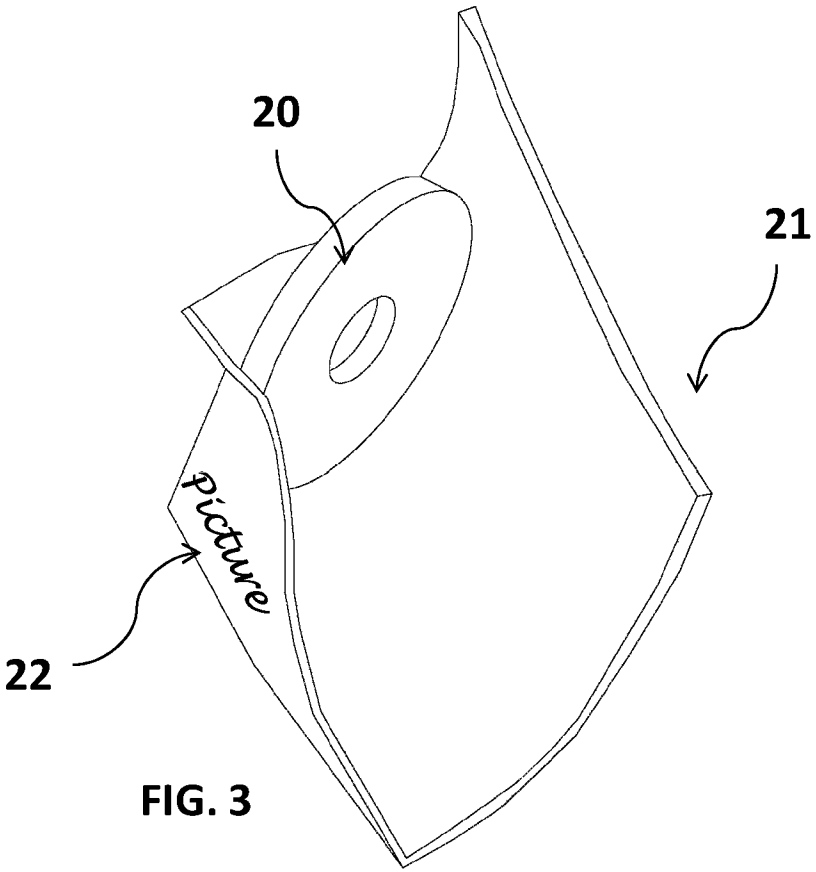
FIG. 3 depicts a circular end cap 20 having no outer channel, where backlit film 21 is wrapped around and adhered to the outer edge of the same 20 via an adhesive. In this embodiment, the end cap 20 is a substantially circular having a center aperture with a diameter sized to accept a lamp socket or a shade rest from a lamp fitter. For simplicity, the digital image 22 is represented by the word image, which would be formed by using a digital printer applying solvent based inks to at least one surface of the backlit film 21. Once the backlit film 21 is completely wrapped around the end cap 20, the remaining end portions of the film 21 are overlapped and secured by an adhesive to form a structure supporting seam.

Embodiments of the present invention include the substrate being a transparent material, FIGS. 2*a*-2*c*, or a translucent material, FIG. 3. The transparent or translucent material may be, without limitation, acrylic glass or backlit film respectively. When assembled, either substrate forms the walls of the custom printed lamp shade. However, these words are not a limitation on the scope of the present invention but are written to detail certain embodiments thereof. The present invention may take different forms. Any changes to the invention, as contemplated by one of ordinary skill in the art, are meant to be captured by this disclosure. Therefore, none of this disclosure should be read or taken as limiting the scope of the invention.

Definitions

To detail the present invention, the following non-limiting terms are used.

The terms "acrylic glass" or "acrylic" generally refer(s) to thermo-plastics which may be obtained via free-radical polymerization of mixtures which comprise methyl methacrylate. These mixtures generally comprise at least 40% by weight, preferably at least 60% by weight and particularly preferably at least 80% by weight or higher, based on the weight of the monomers, of methyl methacrylate. These mixtures for production of polymethyl methacrylates can also comprise other (meth)acrylates copolymerizable with methyl methacrylate. In industry, the expression (meth) acrylates includes methacrylates and acrylates and mixtures of the two. These monomers are well known. Among them are, inter alia, (meth)acrylates which derive from saturated alcohols, e.g. methyl acrylate, ethyl (meth)acrylate, propyl (meth)acrylate, n-butyl (meth)acrylate, tert-butyl (meth) acrylate, isobutyl (meth)acrylate, pentyl (meth)acrylate and 2-ethylhexyl (meth)acrylate; and also (meth)acrylates which derive from unsaturated alcohols, e.g. oleyl (meth)acrylate, 2-propynyl (meth)acrylate, allyl (meth)acrylate, vinyl (meth)acrylate; and also aryl (meth)acrylates, such as benzyl (meth)acrylate or phenyl (meth)acrylate, and in each case the aryl radicals here can be unsubstituted or can have up to four substituents; Cycloalkyl (meth)acrylates, such as 3-vinylcyclohexyl (meth)acrylate, bornyl (meth)acrylate; hydroxyalkyl (meth)acrylates, such as 3-hydroxypropyl (meth)acrylate, 3,4-dihydroxybutyl (meth)acrylate, 2-hydroxyethyl (meth)acrylate, 2-hydroxypropyl (meth)acrylate; Glycol di(meth)acrylates, such as 1,4-butanediol (meth) acrylate, (meth)acrylates of ether alcohols, e.g. tetrahydrofurfuryl (meth)acrylate, vinyloxyethoxyethyl (meth)acrylate; amides and nitriles of (meth)acrylic acid, e.g. N-(3-dimethylaminopropyl)(meth)acrylamide, N-(diethylphosphono)(meth)acrylamide, 1-methacryloylamido-2-methyl-2-propanol; sulfur-containing meth-acrylates, such as ethylsulfinylethyl (meth)acrylate, 4-thiocyanatobutyl (meth)acrylate, ethylsulfonylethyl (meth)acrylate, thiocyanatomethyl (meth)acrylate, methylsulfinylmethyl (meth)acrylate, bis((meth)-acryloyloxyethyl) sulfide; polyfunctional (meth)-acrylates, such as trimethyloylpropane tri(meth)-acrylate.

The terms "backlit," or "backlit film," or "film" generally refer(s) to a specialty vinyl and laminate materials, including but not limited to, synthetic paper (polyolefine type, polystylene type, etc.); natural fiber paper such as cellulose fiber paper (wood-free paper, coated paper, latex impregnated paper, etc.); synthetic resin sheet or film (polyolefine, polyvinyl chloride, polyethylene-terephtharate, polystylene, polymethacrylate, polycarbonate, etc.). Examples of the resin to be used for the receiving layer for the film may include without limitation polyester, polyacrylate, polycarbonate, polyvinyl acetate, styrene-acrylate resin, vinyl toluneacrylate resin, polyurethane, polyamide, urea resin, polycaprolactone, styrene-maleic anhydride resin, polyvinyl chloride, polyacrylonitrile, etc. and mixtures, copolymers of these resins, and others.

The term "digital image" generally refers to a numeric representation (normally binary) of a two-dimensional image, a photo. Depending on whether or not the image resolution is fixed, it may be of vector or raster type. The term may also refer to raster images that have been compressed called bitmap images. Web browsers can display standard internet image formats including GIF, JPEG, and PNG, bitmap formats. It is an embodiment of the present invention where a digital image is loaded onto a computer enabled printer and printed onto a transparent or translucent substrate. The digital image can be, without limitation, a reproduction of fine art, a personal photo, cell phone snapshots, or any digitally represented image.

The term "threaded shade rest" generally refers to common threaded bushings used to secure a hanging lamp shade to a lamp assembly by a finish that can mate with the same. The bushings may also be referred to as reducer bushings.

The term "lamp socket" generally refers to electrical connections that are found in lamps typically having an Edison Screw connector for light bulbs. There are many types of sockets, including without limitation, Phenolic medium base sockets, standard lamp sockets, lamp sockets having a keyless socket and threaded shell with a shade ring, and the like. The present invention is designed so that an end cap's center aperture has a varying diameter that can accommodate and fit flush with various types of lamp sockets.

The End Cap

Figure 1:
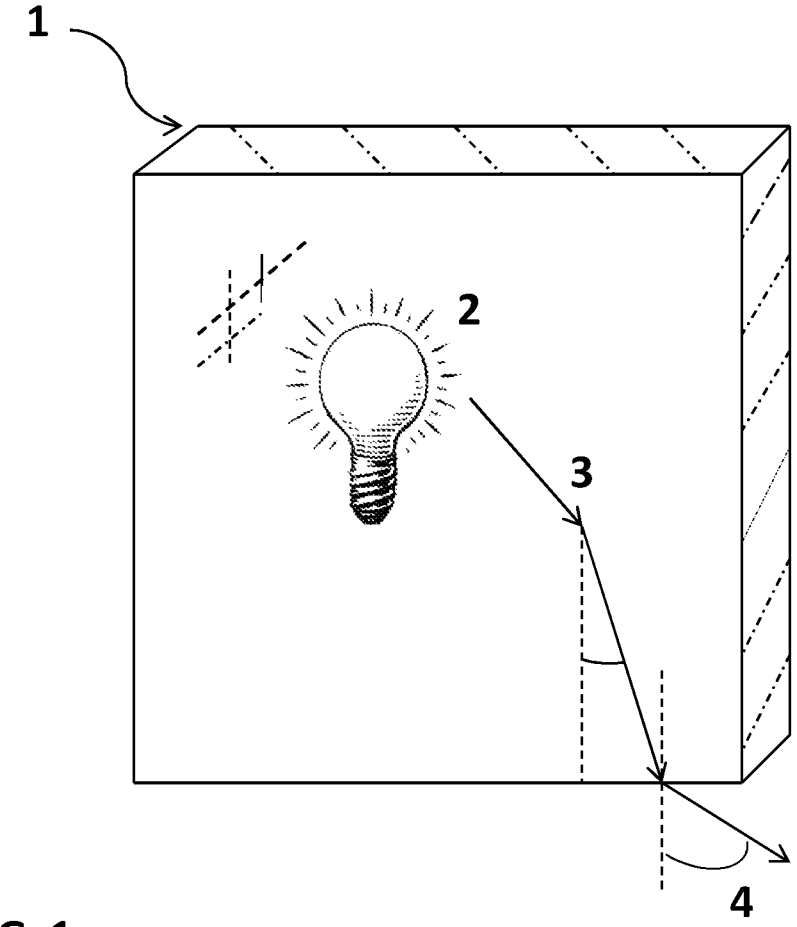
FIG. 1 depicts a sheet of acrylic glass 1 having an incandescent bulb 2 placed directly behind it. The acrylic sheet 1 has a clarity such that the bulb's 2 light 3 is transmitted through the acrylic glass 1 at a refraction angle 4.

FIGS. 2*a*-2*c*, depict the lamp shade as a construct having a substrate 6, 11, 15 that is shaped, reinforced, and secured at its ends by at least one end cap 5, 10, 14. For simplicity, the digital images are not shown on the sides of the lamp shades. Because of its strength, weather-ability, and light transmittance characteristics, acrylic glass (including its copolymer forms) is commonly used as optical parts. According to one embodiment of the present invention, a transparent sheet of acrylic glass with two opposing surfaces, similar to that in FIG. 1, is the preferred material to fashion various shapes for end caps.

However, other end cap 5, 10, 14 starting materials may include without limitation solid wood, natural wood, coniferous wood, hardwood, bamboo, balsa wood, mahogany, basswood, beech, poplar, birch, maple, Douglas fir, spruce, pine, fir, common beech, oak, ash, cherry, walnut, obeche, padouk, teak, veneer, plywood, laminated wood, cork, metal, Earthenware ceramic, technical ceramic, Macor (glass ceramic), ceramic composite, porcelain, earthenware, stoneware, pottery, clay mineral, porcelain stoneware, fine stoneware tiles, kaolin, or any combinations thereof. All configurations of the end cap 5, 10, 14 are meant to be bases that are located at at least one end 5, 10, 14 of a lamp shade to ensure that a single piece is formed when joined with the acrylic or backlit substrate.

It is an embodiment of the present invention wherein a sheet of acrylic glass having a thickness of about a ¼" to about 2.25" is selected and placed under a laser cutter to form an end cap 5, 10, 14. Preferably, an end cap 5, 10, 14 starting material should be acrylic glasses sold under the trade names, including but not limited to, Plexiglas®, ACRYLITE®, Lucite®, Perspex®, Altuglas®, Setapan®, Setacryl®, Lucryl®, Deglas®, Friacryl®, Hesa-Glas®, Limacryl®, Resarit®, Satin Glass®, Setasand®, or Setaletter®. The acrylic sheet is fashioned into an end cap 5, 10, 14 by a $CO_2$ laser cutter that can cut or engrave non-metal materials such as acrylic, a non limiting example being a Eurolaser XL-3200 Laser Cutter Machine capable of a laser power between 30-600 Watts and having motion technology to ensure precision cuts.

$CO_2$ laser cutters are known in the art and are used in combination with a computer that may have proprietary software that accepts manual inputs to create patterns for controlling the routing and eventual laser cutting of intricate designs into and out of acrylic glass. The computer should have a basic operating system, such as MS Windows, Linux, Mac OS, or the like. The computer is capable of storage including but not limited to random access memory, read only memory, hard disks, floppy disks, compact disks, DVDs, flash drives, solid state disks, tape drives, or any other type of device or medium capable of storing information temporarily or permanently. Non-limiting examples of computer inputs and outputs may include, without limitation, a keyboard, a mouse, a trackball, a joystick, a touchpad, and/or a microphone, a CRT monitor, or an LED or LCD display panel.

As such, the user of the present invention should be skilled in 3D and 2D modeling systems and techniques to give cutting instructions to the $CO_2$ laser system. Commercially available programs have free-form surface manipulation capabilities, where 2D traces of parametric curves are made by free handing structures with non-uniform rational B-spline surfaces (NURBS). Within a modeling program, points and line segments in a Cartesian plane, e.g. an [x, y, z,] Cartesian system, are used as predetermined spatial instructions or can be free hand drawn to create virtually solid models for fabricating an end cap with the laser cutter.

An experienced user will understand how to manipulate control points and meshes that define contoured surfaces by using, for example, B-spline curves. Any generic modeling program should be capable of sweeping, extruding, revolving, lofting, slicing, sculpting of a surface, or converting connected points forming 2D parametric contours and straight lines into any imaginable 3D shape, if needed, in vector or raster output formats including but not limited to CDR, SVG, DWG, AI, DXF, CMX, HPGL, PDF, EPS, ZCC, XPS, PLT, BMP, TIF, JPG, PNG, and the like.

Programs for sending instructions to the laser cutter may include without limitation CorelDraw X5, AutoCad 2011, Inkscape, Adobe Illustrator, Draftsightand, RetinaEngrave USB, Euro Laser Connect, 3DM LW (3D Markup Language for Web), Dassault Systemes graphic representation, Virtual Architecture CAD, Ashlar-Vellum Argon—3D Modeling, ArtCAM model, BRL-CAD Geometry, Solidedge Assembly, Pro/ENGINEER Assembly, Data Design System DDS-CAD, CopyCAD Curves, CopyCAD Model, CopyCAD Session, CadStd, CATIA V5 Drawing document, CATIA V5 Part document, CATIA V5 Assembly document, CATIA V5 Manufacturing document, AutoCAD and Open Design Alliance applications, Solidedge Draft, MicroStation design file, Delcam Geometry, Delcam Machining Triangles, ASCII Drawing Interchange file format—AutoCAD, VariCAD drawing file, Wilcom—Wilcom ES Designer Embroidery, Agtek format, EXCELLON, FeatureCAM, FormZ, BRL-CAD, GERBER, T-FLEX CAD, GRAITEC, Auto CAD, Solidworks, Autodesk Inventor, Fusion 3D, Rhino 3D, Alias, Pro-Engineer Sketchup, and the like.

As depicted in FIGS. 2*a*-2*c*, it is a preferred embodiment of the present invention where an end cap's final form is laser cut to be substantially circular 14, substantially triangular 5, or substantially square 10 shaped with either a mostly solid body or cut to have a central hub with spokes that radiate outward. The end cap can take a number of shapes based on the inputs to a laser cutting machine. Each embodiment of the end cap has a center aperture 8, 12, 18 being a hole that has a diameter that is sized to accept a shade rest associated with a lamp fitter or a lamp socket, where the diameter for the center aperture 8, 12, 18 is from about ¼" to about 3". Because the lamp shade is a custom item, the final size of each end cap 5, 10, 14 will be dictated by the style of lamp from which the lamp shade will hang.

However, end caps 14 may be laser cut to give substantially circular lamp shades that have a total diameter from about 5" to about 100" in diameter, where substantially triangular and substantially square lamp shades may be cut to comparable sizes. When the substrate is backlit material, the outer portion of the end cap is joined to the backlit, which is about 1/32" to about 1/16" thick, with an adhesive. No matter the end cap's shape, when the substrate is acrylic glass an outer channel is cut from about 1/16" to about 1/4" from the outer edge of the same, where the channel has a width and depth laser cut to accept the thickness of the acrylic substrate, which may be from about 1/16" to about 1/4" in thickness.

Figure 4B:
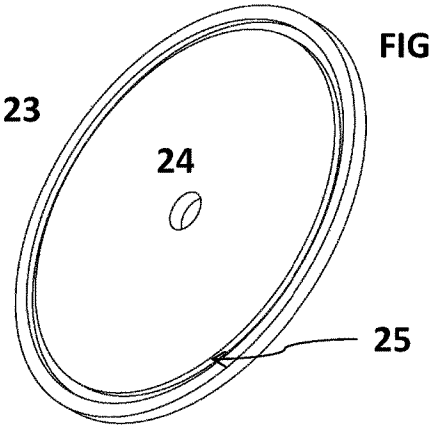
FIG. 4*b* depicts a tilted view of about 45° of a substantially circular end cap 23, with a center aperture 24 having a diameter capable of accepting a lamp socket. However, the aperture 24 may be sized to a diameter to accept a shade rest associated with a lamp fitter or that of a lamp socket. This depiction shows how an outer channel 25 about the outer periphery recesses into the surface of the end cap 23 having a width and depth sized to the thickness of an acrylic substrate.
Figure 4D:
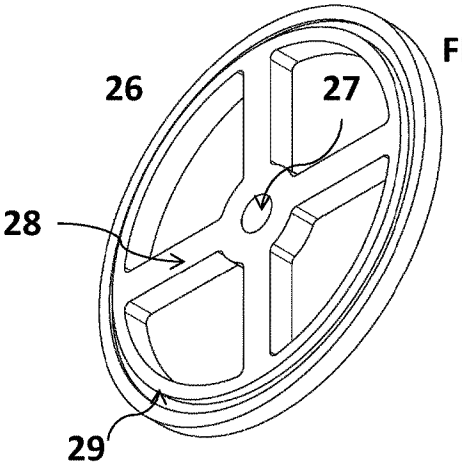
FIG. 4*d* depicts a 45° tilted view of a substantially circular end cap 26 having a center hub with an aperture 27 about a frame with a plurality of spokes 28 that extend there from, which is capable of accepting a threaded portion of a shade rest associated with a lamp fitter or sized to the diameter of a light socket. This depiction shows how an outer 29 channel about the outer periphery recesses into the surface of the end cap 26 having a width and depth sized to the thickness of an acrylic substrate.
Figure 4A:
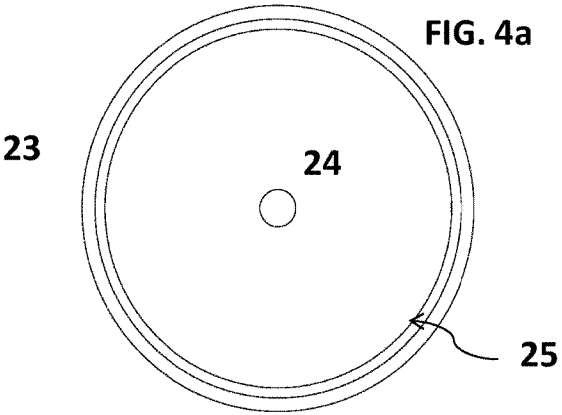
FIG. 4*a* depicts a top elevation view of a substantially circular end cap 23 with a center aperture 24 having a diameter capable of accepting a lamp socket or a shade rest from a lamp fitter. The end cap 23 has an outer channel 25 about the outer periphery with a width and depth sized to the thickness of an acrylic substrate. With this embodiment, save for the center aperture 24, the end cap 23 is more of a solid construct, where the center aperture 24 is the only hole about the disc.
Figure 4C:
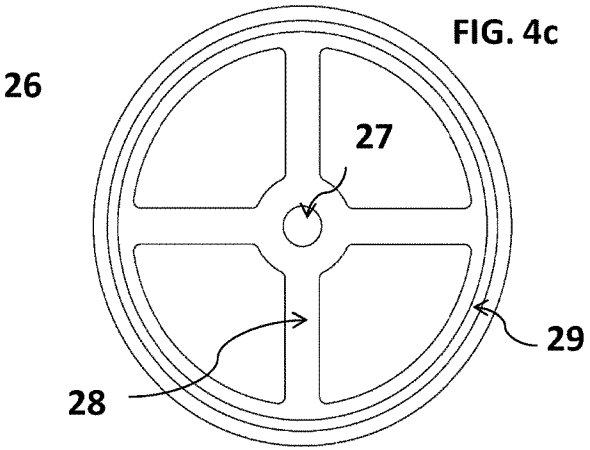
FIG. 4*c* depicts a top elevation view of a substantially circular end cap 26 having a center aperture 27 about a frame with a plurality of spokes 28 extending from the same, which is capable of accepting a threaded portion of a shade rest associated with a lamp fitter or sized to the diameter of a light socket. The end cap 26 has an outer channel 29 about the outer periphery with a width and depth sized to the thickness of an acrylic substrate.

All end caps 5, 10, 14 in FIGS. 2*a*-2*c* are shown to have a central hub with a center cut aperture 8, 12, 18 and symmetrical spokes that radiate outward to end cap edges thereof, mimicking the traditional spokes of a cross bar arm for a spider type fitter. However, FIGS. 4*a*-4*b* depict additional embodiments for an end cap 23, where the end cap 23 lacks the spoke configuration and has a more solid body but retains the center laser cut aperture 24. Although not shown in FIGS. 2*a*-2*c*, in FIGS. 4*a*-4*d* each end cap has a channel 25, 29 cut about its outer periphery laser cut to accept the width or thickness of a digitally printed acrylic substrate.

FIG. 3 depicts an end cap 20 for making the lamp shade with backlit film 21 as the substrate. In this embodiment the end cap 20 does not have an outer channel cut into the recess thereof because the backlit film 21 is a flexible material that is capable of being wrapped around the outer diameter of the same 20. In this embodiment the end cap 20 is laser cut to be substantially circular having a center aperture with a diameter sized to accept a lamp socket, or can be sized to accept the diameter of a shade rest associate with a lamp fitter. However, it is within the scope of the present invention where the substantially solid end cap 20 may be shaped as substantially square or substantially triangular as well. For simplicity, the digital image is represented by the word image 22, which can be applied to the backlit film 21 by using a digital printer applying solvent based inks to at least one surface of the same. Once the backlit film 21 is completely wrapped around the end cap 20, the remaining end portions of the film 21 are overlapped and glued to form a structure supporting seam. The size of all end caps will be based on the size of the lamp that the shade will hang from.

Acrylic Glass as a Substrate

It is an embodiment of the present invention where a substrate with a digitally printed image on at least one of its surfaces forms the walls of the lamp shade. Especially useful as a starting material for a printing substrate, are copolymerized sheets of acrylic glass known as ACRYLITE®, which is manufactured by Evonik Industries under trade secret no. NJTSR #56705700001-7119P or the specialty ACRYLITE® suited for digital printing. These acrylic sheets have superior optical clarity, with T=92% across all thicknesses, a softening temperature from about 100° C. to about 210° C., and a depolymerization temperature of about 250° C. The acrylic sheets typically have a bulk density of about 1.20 g/cm$^3$ at about 20° C. and ideally suited to receive UV-LED curable inks from a digital printer. Commercial acrylic sheets are shipped with an adhesive laminate to guard from scratching the surfaces during shipping.

Acrylic glass is a good substrate for accepting UV-LED curable inks from digital printers. When an acrylic glass sheet is selected, a digital image is reversed printed on at least one area of one side thereof. Digital printers may include, without limitation, a Mutoh ValueJet 1626UH digital printer that is capable of printing a digital image onto an acrylic substrate that is at least 1/2" thick with UV-LED curable inks. The printer is interfaced with a computer having digital images stored thereon and a UV-LED lamp for curing the pigments that are deposited on the acrylic sheet. The custom image stored in the interfaced computer is uploaded into image software, e.g. Photoshop, Paint Shop Pro, or the like, and resized according to the surface size of the acrylic substrate.

The resized image is then transferred to a commercial printer capable of applying UV-LED curable inks onto an acrylic substrate. The digital printer should at least have a minimum droplet size of about 3.7 pl, be variable dot, have a maximum resolution of about 1440 dpi, have a head height up to about 0.5", a maximum medium width of about 64", an operating temperate less than that of the softening temperature of acrylic glass, a UV-LED lamp curing system, and possibly have the printing be drop on demand or piezo drive method printing.

Once the digital image has been reverse printed and cured onto the acrylic substrate, the printed substrate is re-laminated by a dual thermal/cold pressure lamination machine capable of wide format lamination of substrates that are about 5/8" thick, a non-limiting example being a 65" Dual Thermal and Cold Pressure Sensitive Roll Laminator RSH1651 as sold by Royal Sovereign. The laminate that is applied is a flexible gloss white pvc, a non-limiting example being DigiJet 903 3-mil premium white gloss flexible calendered vinyl film coated with a permanent acrylic pressure sensitive adhesive as sold by sfsupplies.com. The printed substrate is laminated to protect the printed image from scratches during the laser cutting process.

A similar $CO_2$ laser cutter, as described above, is used to size the printed acrylic substrate. The size of the digitally printed substrate will depend on the eventual size of the lamp that the lamp shade will hang from. However, for substrates that will be shaped into substantially circular lamp shades, the amount of flat acrylic sheet needed will be dictated by the eventual circumference of the channel that is laser cut into and about the outer periphery of the end cap, where the amount of acrylic glass sheet is dictated by the equation:

$$\pi(3.14)\times\text{diameter of outer channel of the circular end cap}=\text{amount of flat substrate to cut.}$$

An allowance for acrylic glass material is added to ensure that enough material is available to laser cut. For substantially square or substantially triangular lamp shades having end caps with channels about their outer edges, cutting a sheet of acrylic glass will be given by the dimensions of the lengths of each side of each respective structure based on the size of the lamp that the lamp shade will hang from.

Figure 5B:
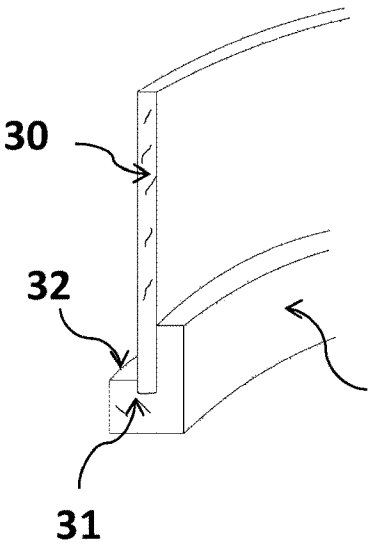
FIG. 5*b* is an inset that depicts a cut away view of the printed substrate 30 sitting flush in the outer channel 31 of the end cap 32. A flanged portion 33 of the end cap 32 act as an inner support for the bottom portion of the printed acrylic substrate 30.
Figure 5A:
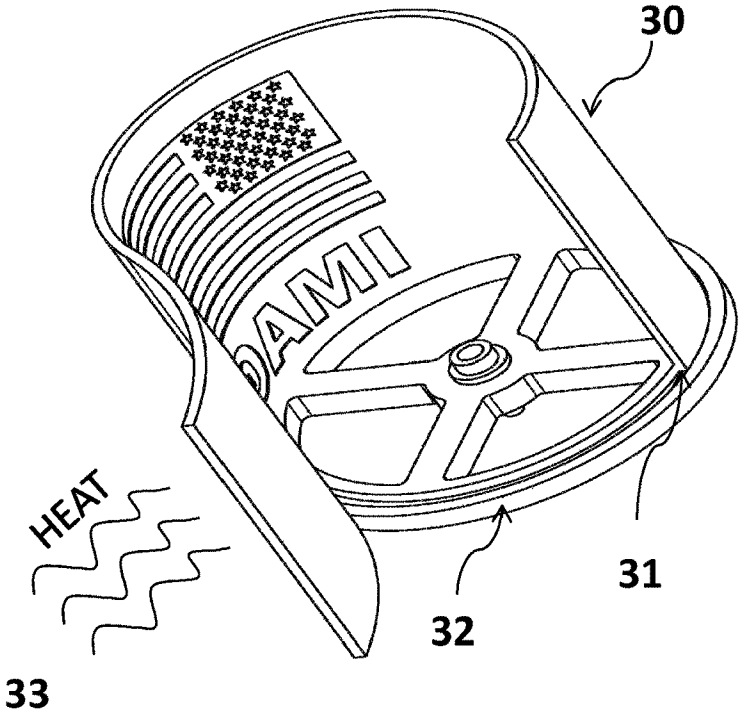
FIG. 5*a* depicts a printed acrylic substrate 30 being guided into the outer channel 31 of a substantially circular end cap 32. Heat 33 is applied to the printed substrate 30 at or near the depolymerization temperature of the acrylic glass to soften it. Once the printed acrylic substrate 30 is softened, it is guided into the outer channel 31 about the outer periphery of the end cap 30 having a width and depth sized to the thickness of the same.

FIG. 5*a* depicts the process of guiding the printed acrylic substrate 30 into an outer channel 31 located about the periphery of an end cap 32. Once laser cut, the printed substrate 30 is softened by applying heat 33 via a heat gun close to or slightly less than the glass transition temperature of the acrylic polymer, which is just below or about 250° C. for about five minutes. The softened substrate 30 is malleable enough to guide into the channel 31 about the outer periphery of the end cap 32. The heated substrate 30 cools for about half an hour as it sits flush in the outer channel 31 of the end cap 32, see FIG. 5*b*, and is supported by an inner flange 33.

Figure 7:
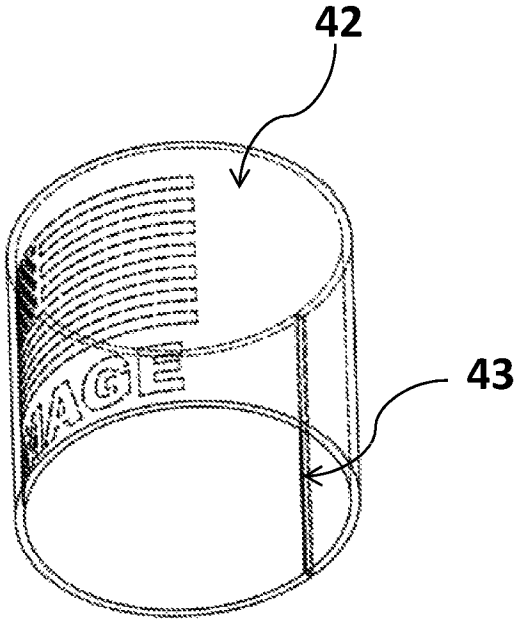
FIG. 7 depicts a joining seam 42 at the back portion of the shaped acrylic substrate 43. Once the acrylic substrate 43 is heated and guided into the outer channel of the end cap (not shown), a joining seam 42 is formed by an adhesive being applied to the seam 42 to keep the joined edges connected.

FIG. 7 depicts the back portion of the printed substrate 42 where, after heating and being guided into the outer channel, the ends are joined to form a seam 43 and sealed by an adhesive to give additional support to the structure as it rests in the channel of the end cap, where the end caps are not shown. The applied adhesive may include without limitation a methacrylate based adhesive.

Backlit Film as a Substrate

FIG. 3 depicts another embodiment of the present invention having a thinner more flexible substrate to form the walls of the lamp shade. A translucent material, such as backlit film, may be used as a substrate 21 for the present invention. Backlit film is a printing medium being a polyester film bearing a coating to absorb solvent based inks. A preferred backlit substrate 21 should have at least the following physical properties being a caliper of 205 microns, a weight of 285 g, a width of 36"/42"/50"/60", a length of 30 m, a core of about 3", L. a. b. of about 85/0/−7.0 for a glossy backlit film to about 85/1/−7.0 for a matte backlit film, and where the gloss is measured at ⅝ for the matte variety and 60°:80/85°:85 for the glossy variety of backlit film.

The backlit substrate 21 should be a polyester based film capable of accepting solvent based inks or UV-LED curable inks from digital printers that are interfaced with a computer having digital images stored thereon. The custom image stored in the interfaced computer is uploaded into image software, e.g. Photoshop, Paint Shop Pro, or the like, and resized according to the surface size of the backlit film. The resized image is then transferred to a commercial printer capable of applying solvent based ink to the backlit film substrate 21.

A solvent ink type digital printer may include, without limitations, an HP Latex 360 Printer, where the printer is capable of a print quality color of about 1200×1200 dpi, and having an average printing power of 4.6 kW. The solvent based inks of the present invention may be a commercial mixture of γ-Butyrolatone, Diethylene glycol diethyl ether, Tetraethylene glycol dimethyl ether, organic materials, Tetraethylene glycol monobutyl ether, and dyes or pigments, or any combinations thereof, where the pigments have a measure of elasticity when printed into the backlit film 21.

In this embodiment the end cap does not have an outer channel cut into the recess thereof because the backlit is a flexible material capable of being wrapped around the outer diameter of the same. In this embodiment the end cap 20 is a substantially circular having a center aperture with a diameter sized to accept a lamp socket, or can be sized to accept the diameter of a shade rest associate with a lamp fitter. However, it is within the scope of the present invention where the substantially solid end cap 20 may be shaped as substantially square or substantially triangular as well. For simplicity, the digital image 22 is represented by the word "Picture", which can be applied to the backlit film by using a digital printer applying solvent based inks to at least one surface of the same. The image may be reverse printed on the backlit 21 surface that will be closest to the light source or directly printed on the viewing surface of the same. Once the backlit film 21 is completely wrapped around the end cap 20 and secured by an adhesive that joins the two, the remaining end portions of the film are overlapped and glued to form a structure supporting seam. The applied adhesive may include without limitation a methacrylate based adhesive or any adhesive commonly used to adhere backlit film 21.

EXAMPLE LAMP SHADES

Figure 6:
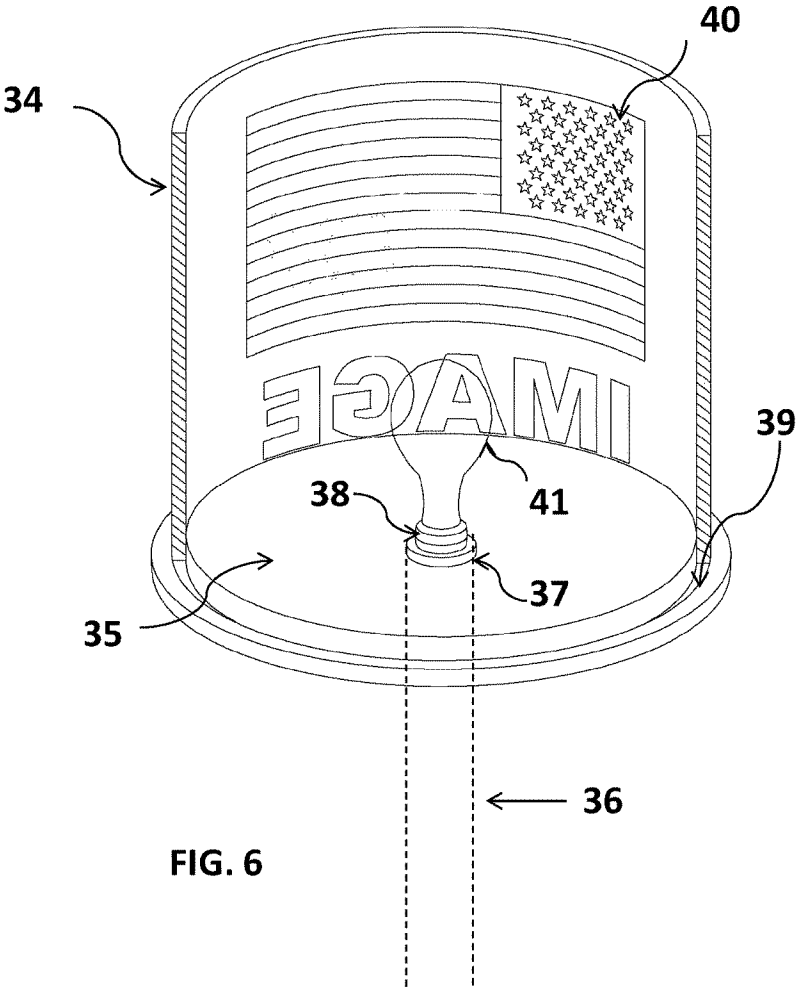
FIG. 6 depicts a cut away view a cylindrical lamp shade made from an acrylic glass substrate 34. In this embodiment, the end cap 35 is inverted and is attached to a tube 36 of a floor lamp via an aperture 37 cut into the center of the circular end cap 35 that accepts a light socket 38 of the floor lamp.

FIG. 6 depicts a cut away view a cylindrical lamp shade made from an acrylic glass substrate 34. In this embodiment, the end cap 35 is inverted and attached to a tube 36 of a floor lamp via an aperture 37 cut into the center of the circular end cap 35. The aperture is sized to accept a light socket 38 portion of the floor lamp. The acrylic substrate 34 curves into an outer channel 39 about the periphery of the circular end cap 35 for support and shaping, as depicted in FIG. 5*a*. The inside surface of the acrylic substrate 34 has a reverse image 40 digitally printed. The viewing side of the lamp shade will show a user an illuminated image 40 via light emanating from a light bulb 41 that passes through the substrate 34. This embodiment does not show a top end cap for the lamp shade but may be included just the same, with or without the end cap's 35 center aperture 37.

Figure 8:
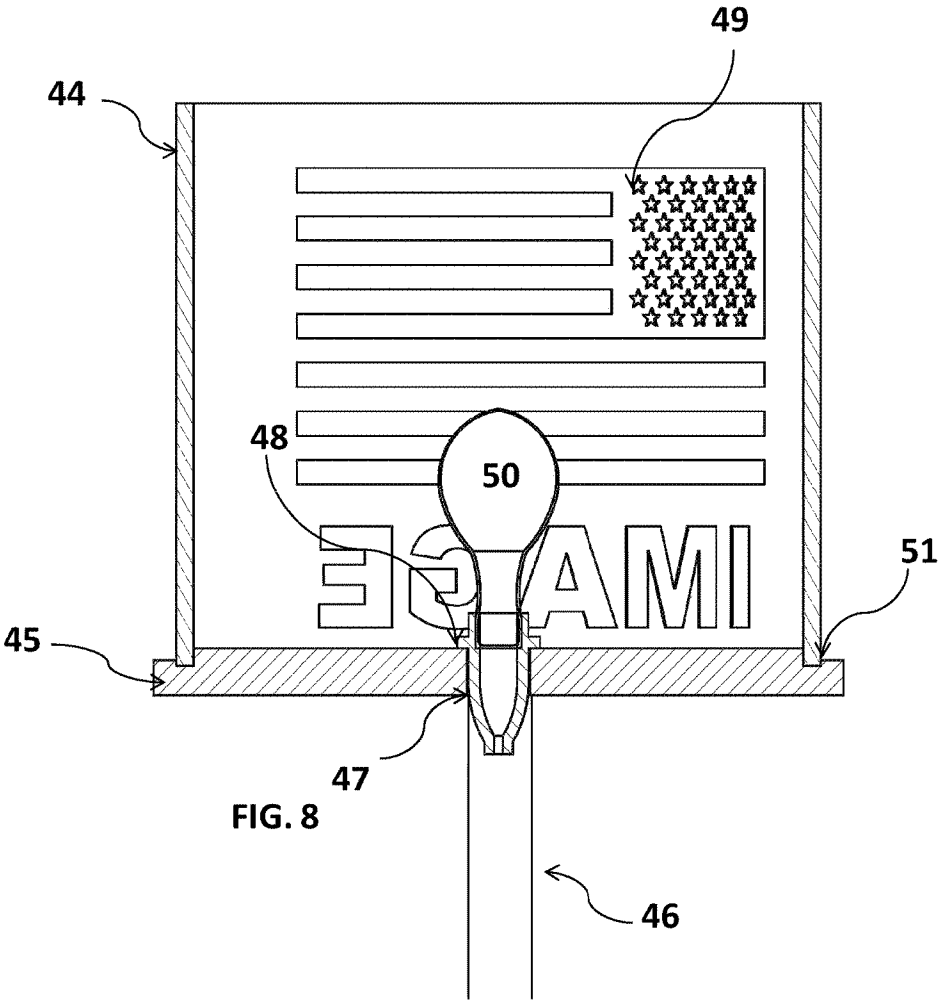
FIG. 8 depicts a cross section view of a substantially square lamp shade made from an acrylic glass substrate 44 without the curved nature of the substrate in FIG. 6. In this embodiment, the end cap 45 is inverted and is attached to a tube 46 of a floor lamp via an aperture 47 cut into the center of the substantially square end cap 45 that accepts the light socket 48 from the floor lamp.

FIG. 8 depicts a cross section view of a substantially square lamp shade made from an acrylic glass substrate 44 without the curved nature of the substrate in FIG. 6. In this embodiment, the end cap 45 is inverted and is attached to a tube 46 of a floor lamp via an aperture 47 cut into the center of the substantially square end cap 45 that accepts the light socket 48 from the floor lamp. A digital image 49 is reverse printed onto the inside surface of the acrylic substrate 44. The viewing side of the lamp shade will show a user an illuminated image 49 via light emanating from a light bulb 50 that passes through the substrate 44. The acrylic substrate 44 sits in an outer channel 51 about the periphery of the square end cap 45 for support and shaping. This embodiment does not show a top end cap for the lamp shade but may be included just the same, with or without the end cap's 45 center aperture 47. If desired, this embodiment can have four equal sides each having a digitally printed image 49 for illumination.

The foregoing words describe embodiments for a custom printed lamp shade. When assembled, light passing substrates with digitally printed images form lamp shade walls that are shaped by at least one end cap. The digitally printed image on either substrate is illuminated by a light source when the lamp shade hangs from a lamp. However, these words are not a limitation on the scope of the present invention but are written to detail certain embodiments thereof. The present invention may take different forms. Any changes to the invention, as contemplated by one of ordinary skill in the art, are meant to be captured by this disclosure. Therefore, none of this disclosure should be read or taken as limiting the scope of the invention. But, the invention is captured by the following claims.

I claim:

1. A custom printed lamp shade comprising:

a.) a substrate being a transparent sheet of acrylic glass having a reverse digital image printed on one side;

b.) two transparent acrylic glass end caps, wherein at least one end cap includes a center aperture, spokes that radiate outward from the center aperture, and an outer channel capable of accepting the thickness of the transparent sheet of acrylic glass having a reverse digital image printed on one side;

c.) wherein the center aperture of the transparent acrylic glass end cap is sized to accept a diameter for a threaded portion of a shade rest lamp fitter, a diameter that is sized to accept a threaded portion of a lamp socket, or lamp socket having a lamp ring; and d.) wherein the edges of the transparent sheet of acrylic glass join about the channel of at least one end cap.

2. The custom printed lamp shade of claim 1, wherein the transparent sheet of acrylic glass can accept UV-LED curable inks from a digital printer for printing the reverse digital image thereon.

3. The custom lamp shade of claim 1, wherein each end cap is laser cut to be substantially square, substantially triangular, or substantially circular.

4. The custom printed lamp shade of claim 1, wherein the transparent sheet of acrylic glass is shaped by a substantially square, substantially triangular, or substantially circular end cap to form lampshade walls having such corresponding shapes.

5. The custom printed lamp shade of claim 1, wherein the digital image printed about the surfaces of the substrate is illuminated by a light source associated with a lamp.

6. The custom printed lampshade of claim 1, wherein the transparent sheet of acrylic glass has a thickness from an 1/16" to a 1/4", a transparency of 92%, and has a bulk density of 1.20 g/cm$^3$ at 20° C.

7. A method of manufacturing a custom printed lampshade comprising:

a. sizing a sheet of transparent acrylic glass with a laser cutter;

b. using a digital printer capable of applying UV-LED curable inks to print a reverse digital image onto one side of the transparent sheet of acrylic glass;

c. laser cutting acrylic glass into an end cap:

i. being a circle, a square with round edges, or a triangle with round edges having a center aperture with a diameter sized to accept a shade rest of a lamp fitter, or a diameter sized to accept a lamp socket, or a diameter sized to accept a lamp socket with a lamp ring, and spokes that radiate outward therefrom;

ii. wherein the end cap is laser cut and accepts edges of a transparent sheet of acrylic glass having a reverse digital image printed thereon;

d. applying heat to the transparent sheet of acrylic glass having the reverse digital image printed thereon to a depolymerization temperature that softens the acrylic glass to hand guide the sheet of acrylic glass into of the end cap; and e. forming the custom printed lamp shade by securing the transparent sheet of acrylic glass, having the reverse digital image printed thereon, about the end cap via an adhesive.

* * * * *